US007445002B2

(12) United States Patent
Christopher et al.

(10) Patent No.: US 7,445,002 B2
(45) **Date of Patent: *Nov. 4, 2008**

(54) DIFFERENTIAL DETECTION SYSTEM FOR CONTROLLING FEED OF A PAINTBALL LOADER

(75) Inventors: James T. Christopher, Sachse, TX (US); Chris T. Goddard, Lewisville, TX (US); David Michael Banks, Dallas, TX (US)

(73) Assignee: KEE Action Sports I LLC, Sewell, NJ (US)

( * ) Notice: Subject to any disclaimer, the term of this patent is extended or adjusted under 35 U.S.C. 154(b) by 284 days.

This patent is subject to a terminal disclaimer.

(21) Appl. No.: 11/116,774

(22) Filed: Apr. 28, 2005

(65) Prior Publication Data

US 2005/0217653 A1 Oct. 6, 2005

Related U.S. Application Data

(63) Continuation of application No. 10/414,134, filed on Apr. 14, 2003, now Pat. No. 6,889,680.

(60) Provisional application No. 60/372,273, filed on Apr. 12, 2002.

(51) Int. Cl.
*F41B 11/02* (2006.01)

(52) U.S. Cl. ..... 124/51.1

(58) Field of Classification Search ..... 124/48, 124/51.1, 52

See application file for complete search history.

(56) References Cited

U.S. PATENT DOCUMENTS 1,403,719 A 1/1922 Szepe
1,404,689 A 1/1922 Fairweather
1,743,576 A 1/1930 Smith
1,867,513 A 7/1932 Johannes
2,307,015 A 1/1943 Boynton
2,357,951 A 9/1944 Hale
2,398,263 A 4/1946 Trimbach
3,248,008 A 4/1966 Meierjohan
3,467,073 A 9/1969 Rhodes
3,610,223 A 10/1971 Green
3,695,246 A 10/1972 Filippi et al.
3,788,298 A 1/1974 Hale (Continued)

FOREIGN PATENT DOCUMENTS

DE 3721527 1/1989

(Continued)

*Primary Examiner*—John Ricci
(74) *Attorney, Agent, or Firm*—Volpe and Koenig P.C.

(57) ABSTRACT

The present invention is directed to a ball feed mechanism for use in a paintball loader. The ball feed mechanism includes a feeder which conveys or impels balls toward a feed neck, and a drive member which is concentric with the feeder. The feeder is coupled to the drive member through a spring. The spring is configured to store potential energy which is used to rotate the feeder and, thus, drive the balls toward the feed neck. An electric motor is used to rotate the drive member to wind the spring. The feed mechanism includes sensors which detect the motion of the feeder and the drive member. A controller determines the spring tension based on the relative motion of the feeder and drive member, and actuates a motor when necessary.

12 Claims, 8 Drawing Sheets

U.S. PATENT DOCUMENTS

| | | | |
|---|---|---|---|
| 3,844,267 | A | 10/1974 | Mohr |
| 3,855,988 | A | 12/1974 | Sweeton |
| 3,867,921 | A | 2/1975 | Politzer |
| 4,027,646 | A | 6/1977 | Sweeton |
| 4,185,824 | A | 1/1980 | Natwick |
| 4,207,857 | A | 6/1980 | Balka, Jr. |
| 4,332,097 | A | 6/1982 | Yatlor, Jr. |
| 4,646,709 | A | 3/1987 | Kholin |
| 4,819,609 | A | 4/1989 | Tippmann |
| 4,896,646 | A | 1/1990 | Kahelin et al. |
| 4,926,742 | A | 5/1990 | Ma et al. |
| 4,930,400 | A | 6/1990 | Brandl et al. |
| 4,936,282 | A | 6/1990 | Dobbins et al. |
| 4,951,548 | A | 8/1990 | Wixon et al. |
| 4,951,644 | A | 8/1990 | Bon |
| 4,965,951 | A | 10/1990 | Miller et al. |
| 4,986,251 | A | 1/1991 | Lilley |
| 4,993,400 | A | 2/1991 | Fitzwater |
| 5,063,905 | A | 11/1991 | Farrell |
| 5,097,816 | A | 3/1992 | Miller |
| 5,097,985 | A | 3/1992 | Jones |
| 5,166,457 | A | 11/1992 | Lorenzetti |
| 5,282,454 | A | 2/1994 | Bell et al. |
| 5,335,579 | A | 8/1994 | David |
| 5,353,712 | A | 10/1994 | Olson |
| 5,383,442 | A | 1/1995 | Tippmann |
| 5,456,153 | A | 10/1995 | Bentley et al. |
| 5,490,493 | A | 2/1996 | Salansky |
| 5,497,758 | A | 3/1996 | Dobbins et al. |
| 5,505,188 | A | 4/1996 | Williams |
| 5,511,333 | A | 4/1996 | Farrell |
| 5,520,171 | A | 5/1996 | David |
| 5,542,570 | A | 8/1996 | Nottingham et al. |
| 5,561,258 | A | 10/1996 | Bentley et al. |
| 5,600,083 | A | 2/1997 | Bentley et al. |
| 5,722,383 | A | 3/1998 | Tippmann, Sr. et al. |
| 5,727,538 | A | 3/1998 | Ellis |
| 5,736,720 | A | 4/1998 | Bell et al. |
| 5,749,797 | A | 5/1998 | Sunseri et al. |
| 5,771,875 | A | 6/1998 | Sullivan |
| 5,784,985 | A | 7/1998 | Lodico et al. |
| 5,791,325 | A | 8/1998 | Anderson |
| 5,794,606 | A | 8/1998 | Deak |
| 5,809,983 | A | 9/1998 | Stoneking |
| 5,816,232 | A | 10/1998 | Bell |
| 5,839,422 | A | 11/1998 | Ferris |
| 5,881,962 | A | 3/1999 | Schmidt et al. |
| 5,887,578 | A | 3/1999 | Backeris et al. |
| 5,947,100 | A | 9/1999 | Anderson |
| 5,954,042 | A | 9/1999 | Harvey |
| 6,032,395 | A | 3/2000 | Bentley et al. |
| 6,055,975 | A | 5/2000 | Gallagher et al. |
| 6,109,252 | A | 8/2000 | Stevens |
| 6,206,562 | B1 | 3/2001 | Eyraud et al. |
| 6,213,110 | B1 | 4/2001 | Christopher et al. |
| 6,220,237 | B1 | 4/2001 | Johnson et al. |
| 6,305,367 | B1 | 10/2001 | Kotsiopoulos et al. |
| 6,327,953 | B1 | 12/2001 | Andresen |
| 6,347,621 | B1 | 2/2002 | Guthrie |
| 6,374,819 | B1 | 4/2002 | Ming-Hsien |
| 6,408,837 | B1 | 6/2002 | Johnson et al. |
| D459,767 | S | 7/2002 | Rushton |
| 6,415,781 | B1 | 7/2002 | Perrone |
| 6,418,919 | B1 | 7/2002 | Perrone |
| 6,425,781 | B1 | 7/2002 | Bernstein et al. |
| 6,460,530 | B1 | 10/2002 | Backeris et al. |
| 6,467,473 | B1 | 10/2002 | Kostiopoulos |
| 6,468,879 | B1 | 10/2002 | Lamure et al. |
| 6,481,432 | B2 | 11/2002 | Rushton et al. |
| 6,488,019 | B2 | 12/2002 | Kotsiopoulos |
| 6,502,567 | B1 | 1/2003 | Christopher et al. |
| 6,526,955 | B1 | 3/2003 | Juan |
| 6,591,824 | B2 | 7/2003 | Hatcher |
| 6,609,511 | B2 | 8/2003 | Kotsiopoulos et al. |
| 6,615,814 | B1 | 9/2003 | Rice et al. |
| 6,644,293 | B2 | 11/2003 | Jong |
| 6,684,873 | B1 | 2/2004 | Anderson et al. |
| 6,701,907 | B2 | 3/2004 | Christopher et al. |
| 6,708,685 | B2 | 3/2004 | Masse |
| 6,729,321 | B2 | 5/2004 | Ho |
| 6,729,497 | B2 | 5/2004 | Rice et al. |
| 6,739,322 | B2 | 5/2004 | Rice et al. |
| 6,739,323 | B2 | 5/2004 | Tippmann, Jr. |
| 6,742,512 | B1 | 6/2004 | Ho |
| 6,752,137 | B2 | 6/2004 | Brunette |
| 6,792,933 | B2 | 9/2004 | Christopher et al. |
| 6,802,306 | B1 | 10/2004 | Rice |
| 6,860,258 | B2 | 3/2005 | Farrell |
| 6,889,680 | B2 | 5/2005 | Christopher et al. |
| 6,915,792 | B1 | 7/2005 | Sheng |
| 6,978,776 | B2 | 12/2005 | Hamilton |
| 6,981,493 | B1 | 1/2006 | Poteracku |
| 7,017,569 | B2 | 3/2006 | Jong |
| 7,021,302 | B2 | 4/2006 | Neumaster |
| 7,077,118 | B2 | 7/2006 | Lewis |
| 7,159,585 | B2 | 1/2007 | Quinn et al. |
| 7,270,121 | B2 | 9/2007 | Lubben |
| 2002/0059927 | A1 | 5/2002 | Woods |
| 2003/0079731 | A1 | 5/2003 | Dobbins |
| 2004/0211402 | A1 | 10/2004 | Christopher et al. |
| 2005/0274370 | A1 | 12/2005 | Lubben |
| 2006/0086347 | A1 | 4/2006 | Hedberg |
| 2006/0249131 | A1 | 11/2006 | Broersma |
| 2006/0254572 | A1 | 11/2006 | Hall |
| 2007/0101981 | A1 | 5/2007 | Chen |

FOREIGN PATENT DOCUMENTS

| | | |
|---|---|---|
| DE | 4343870 | 6/1994 |
| DE | 19922589 | 12/2000 |
| EP | 01054228 | 11/2000 |
| EP | 01653189 | 5/2006 |
| GB | 2322438 | 8/1998 |
| WO | 98/13660 | 4/1998 |
| WO | 01/44745 | 6/2001 |

DIFFERENTIAL DETECTION SYSTEM FOR CONTROLLING FEED OF A PAINTBALL LOADER

CROSS REFERENCE TO RELATED APPLICATION(S)

This application claims benefit of U.S. Pat. No. 6,889,680 which issued on May 10, 2005, which in turn claimed priority to U.S. Provisional Patent Application No. 60/372,273 filed Apr. 12, 2002, both of which are incorporated herein by reference in its entirety.

FIELD OF INVENTION

This invention relates to paintball loaders and, more particularly, to a detection system for controlling ball feed in a paintball loader.

BACKGROUND

Popularity and developments in the paintball industry have led to the demand for increased performance from paintball guns. Paintball gun users usually partake in paintball war games. A paintball war game is generally played between two teams of players that try to capture the opposing team's flag. Each flag is located at the team's home base. Such a game is played on a large field with opposing home bases at each end. The players are each armed with a paintball gun that shoots paintballs. Paintballs are gelatin-covered spherical capsules filled with paint.

During the game, the players of each team advance toward the opposing team's base in an to attempt to steal the opposing team's flag. The players must do so without first being eliminated from the game by being hit by a paintball shot by an opponent's gun. When a player is hit by a paintball the gelatin capsule ruptures and the paint is splashed onto the player. As a result the player is "marked" and is out of the game.

These war games have increased in popularity and sophistication resulting in more elaborate equipment. One such improvement is the use of semi-automatic and automatic paintball guns which allow for rapid firing of paintballs. As a result of the increased firing speed, a need has developed for increased storage capacity of paintballs in the paintball loaders that are mounted to the gun. Also, users demand faster feed rates as the guns continue to develop.

Paintball loaders typically include a housing that sits on an upper portion of a paintball gun and which is designed to hold a large quantity of paintballs. There is an outlet tube at the bottom of the housing through which the paintballs drop by the force of gravity. The paintballs pass into an inlet tube located in the upper portion of the gun.

In use, paintballs fall sequentially through the outlet tube into the inlet of the gun. The inlet tube directs each paintball into the firing chamber of the gun where the paintball is propelled outwardly from the gun by compressed air. Because existing paintball loaders rely on the force of gravity to feed the paintballs to the gun, they function properly to supply paintballs only if the gun and the loader are held in a substantially upright position. If, during a game, a player is forced to hold the gun sideways or upside down, the loader will not function properly.

Furthermore, it is not uncommon that, while feeding paintballs to the gun, the paintballs jam in the gun. In order to correct the problem, the player may shake the gun or strike the loader in order to dislodge the jammed paintball. This obviously places the player at risk during the game since the player is distracted by the need to adjust the equipment.

Currently there are on the market paintball loaders that utilize an optical sensor mounted within the loaders to detect the absence of a paintball in the infeed tube of a paintball gun. When the sensor detects that there is no paintball in the infeed tube of the paintball gun, a motor is activated which causes a paddle to force a paintball into the paintball gun. Other conventional paintball loaders utilize agitators having sound sensors to sense a gun firing event. In response to the sound of the gun firing, an electrical signal is sent to activate an agitator which moves a paintball into the feed tube.

While recent feed systems are an improvement over the prior feeders, the current feed systems are complicated and costly to manufacture. Such systems may also lead to jamming.

There is, therefore, a need for a feed mechanism for a feed system that simply and reliably feeds paintballs to a paintball gun at a high rate, while at the same time prevents or reduces the likelihood of paintball jams. There is also a need for a paintball loader which controls the feed motor so as to prolong battery life and reduce undesirable noise.

SUMMARY

In one aspect, the present invention is a ball feed mechanism for use in a paintball loader. The ball feed mechanism includes a feeder for feeding paintballs. The feeder may be a drive cone, paddle wheel, or indexing belt, which has protrusions, recesses or paddles that convey or impel balls toward a feed neck. The feed mechanism also preferably includes a drive shaft which is concentric with the feeder. The feeder mounts on the drive shaft and is free to rotate about the drive shaft before engaging mechanical stops. The feeder is coupled to the drive shaft through a spring. The spring is configured to store potential energy which is used to rotate the feeder and, thus, drive the balls toward the feed neck. An electric motor is used to rotate the drive shaft to wind or compress the spring.

In operation the spring is normally compressed so that the spring energy is always available to impel balls toward the feed neck as required. The motor is energized as needed to restore the spring energy (e.g., through compression of the spring). Other resilient members, such as elastomers, may be used in place of the spring.

The feed mechanism includes an indexing mechanism which includes a sensor, for example, to determine the degree of tension or winding of the spring. In one embodiment, the indexing mechanism accomplishes this by using the sensors to detect rotational movement of the feeder and a drive mechanism (which includes the drive shaft). A controller is in communication with the sensors and determines the relative position of the feed mechanism to the drive mechanism for determining whether the spring requires winding. The relative position of the feeder and drive mechanism can be correlated with the degree of compression/tension of the spring. If the controller determines that the spring requires winding, a motor is activated, causing the drive mechanism to rotate. This, in turn, causes the spring to wind.

The feed mechanism may alternately include a tensionometer or a strain gauge in communication with a controller. These devices are used to determine the state of deflection of the spring. If the controller determines that additional deflection of the spring is required, the controller will actuate a motor which rotates the drive mechanism and the spindle. The rotation of the spindle, in turn, causes the spring to compress or tension.

The foregoing and other features of the invention and advantages of the present invention will become more apparent in light of the following detailed description of the preferred embodiments, as illustrated in the accompanying figures. As will be realized, the invention is capable of modifications in various respects, all without departing from the invention. Accordingly, the drawings and the description are to be regarded as illustrative in nature, and not as restrictive.

BRIEF DESCRIPTION OF THE DRAWING(S)

The foregoing summary, as well as the following detailed description of the invention, will be better understood when read in conjunction with the appended drawings. In the drawings.

DETAILED DESCRIPTION OF THE PREFERRED EMBODIMENTS

Figure 1:
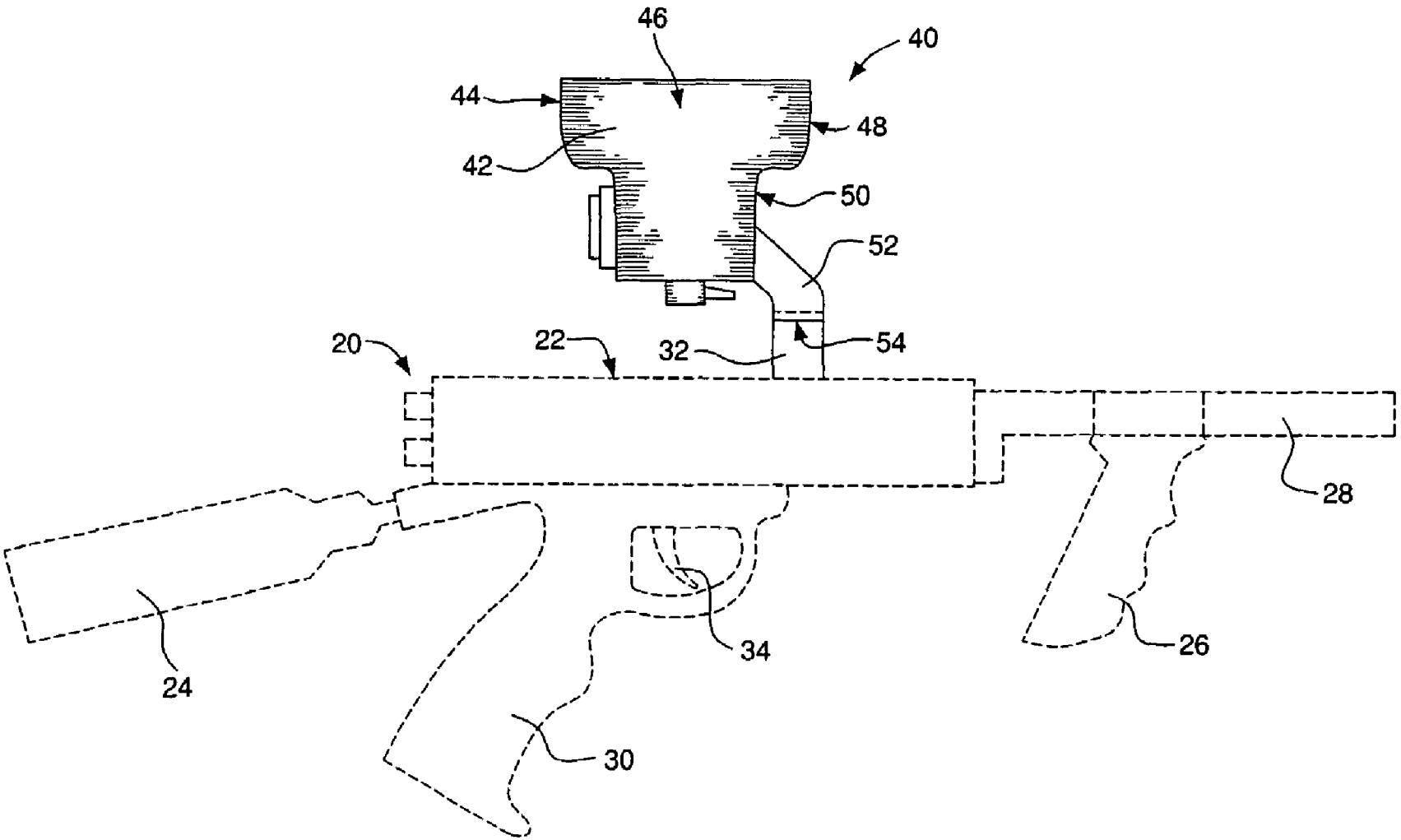
FIG. 1 is a side elevation view of a rapid feed paintball loader constructed in accordance with the teachings of the present invention and operatively attached to a representative paintball gun illustrated in phantom.

Referring now to the drawings wherein like numerals indicate like elements throughout, FIG. 1 is a side elevation view of paintball loader 40 in accordance with the present invention and operatively attached to a representative paintball gun 20, illustrated in phantom. The paintball gun 20, includes a main body 22, a compressed gas cylinder 24, a front handgrip 26, a barrel 28, and a rear handgrip 30. The paintball gun 20 also includes an inlet tube 32, leading to a firing chamber (not shown) in the interior of the main body and a trigger 34. The front handgrip 26 preferably extends downwardly from the barrel 28 and provides a grip. The compressed gas cylinder 24 is typically secured to a rear portion of the paintball gun 20. The compressed gas cylinder normally contains CO2, NO2 or air, although other gases may also be used.

In using the paintball gun 20, trigger 34 is squeezed, thereby actuating the compressed gas cylinder to release controlled bursts of compressed gas. The bursts of gas are used to eject paintballs outwardly through the barrel 28. The paintballs are continually fed by the paintball loader 40 through the inlet tube of the firing chamber. The paintball gun depicted in FIG. 1 is an automatic paintball gun, however the gun may also be semi-automatic.

The paintball loader 40 comprises a paintball container 42 having a container wall 44 forming an interior area 46. The container has an upper portion 48 and a lower portion 50. An exit tube 52 leads from the lower portion of the container to an outlet opening 54. The exit tube is positioned on top of the inlet tube 32 of the paintball gun 20. A feed mechanism 100 (shown in FIG. 2) is used to drive or urge the paintballs toward the exit tube and into the inlet tube 32.

Figure 2:
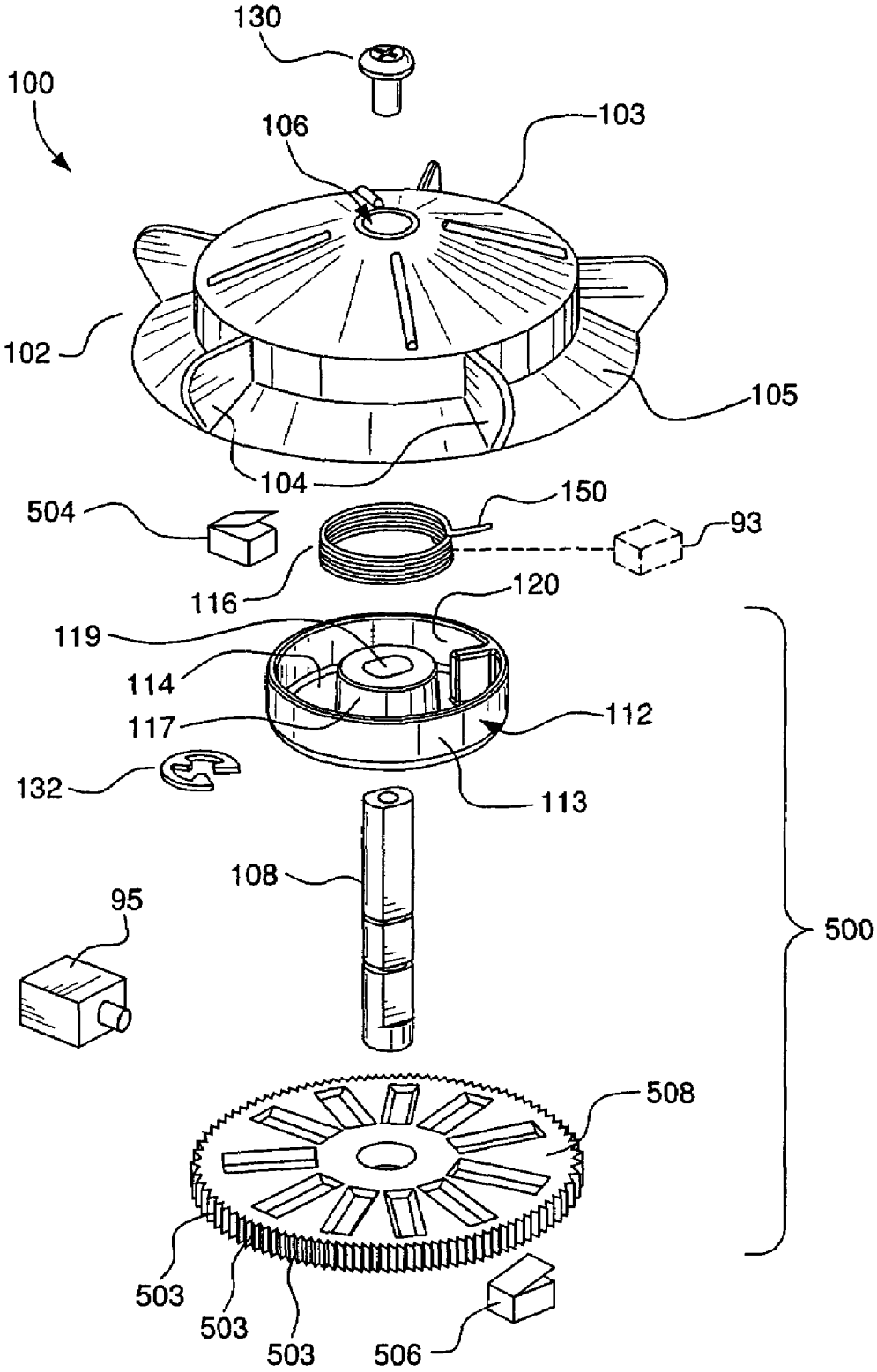
FIG. 2 is an exploded upper isometric view of one embodiment of the loader according to the present invention.

FIG. 2 is an exploded isometric view of one embodiment of the feed mechanism 100 according to the present invention. While a preferred feed mechanism 100 is shown, various other components may be substituted therefore for driving paintballs into the paintball gun 20. The feed mechanism 100 includes a feeder 102 which drives or otherwise conveys paintballs into the exit tube 52, and a drive mechanism 500.

A variety of feeders 102 can be used in the present invention, including an feeder, drive cone, paddle wheel, carrier or other device which can direct or otherwise urge paintballs from the loader into the exit tube 52. One preferred feeder 102 is shown in the figures and includes a housing 103 with a plurality of fins 104 which preferably extend in a radial direction from the housing 103. While the fins 104 are shown as being straight, other shapes can be used as will be discussed below. The feeder 102 also preferably includes flanges 105 that extend between adjacent fins 104. As should be apparent from the drawings, the housing, fins and flanges can be made as a single injection molded part. While fins are shown, the feeder may include recesses within which the paintballs sit as they are shuttled toward the exit tube.

A cylindrical opening 106 is formed in the center of the housing 103 for receiving a fastener 130. The fastener 130 is used to engage or mount the feeder 102 to a drive shaft or spindle 108 of the drive mechanism 500. More particularly, the fastener 130 extends through the opening 106 and threads into a hole formed in the top of the drive shaft 108.

Figure 3:
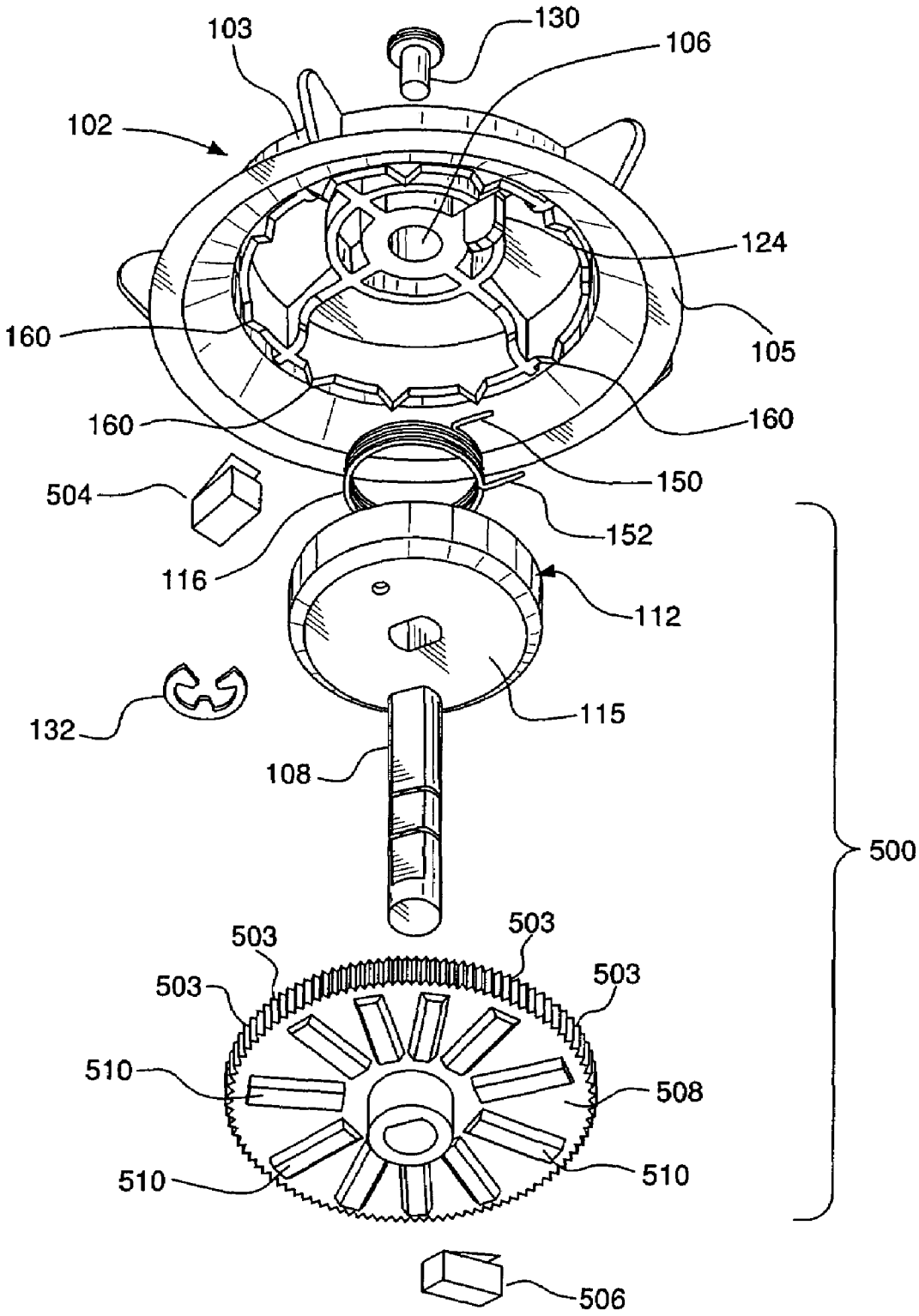
FIG. 3 is an exploded lower isometric view of the embodiment of the loader shown in FIG. 2.

Referring now to FIG. 3, the bottom of the feeder 102 is shown in more detail. The housing 103 includes a first flange 124 which is attached to and projects downward from the housing 103. In the illustrated embodiment, the first flange 124 is formed integral with the housing 103. The first flange 124 is designed to engage with a first end of a spring 116 as will be better understood hereafter.

Figure 4:
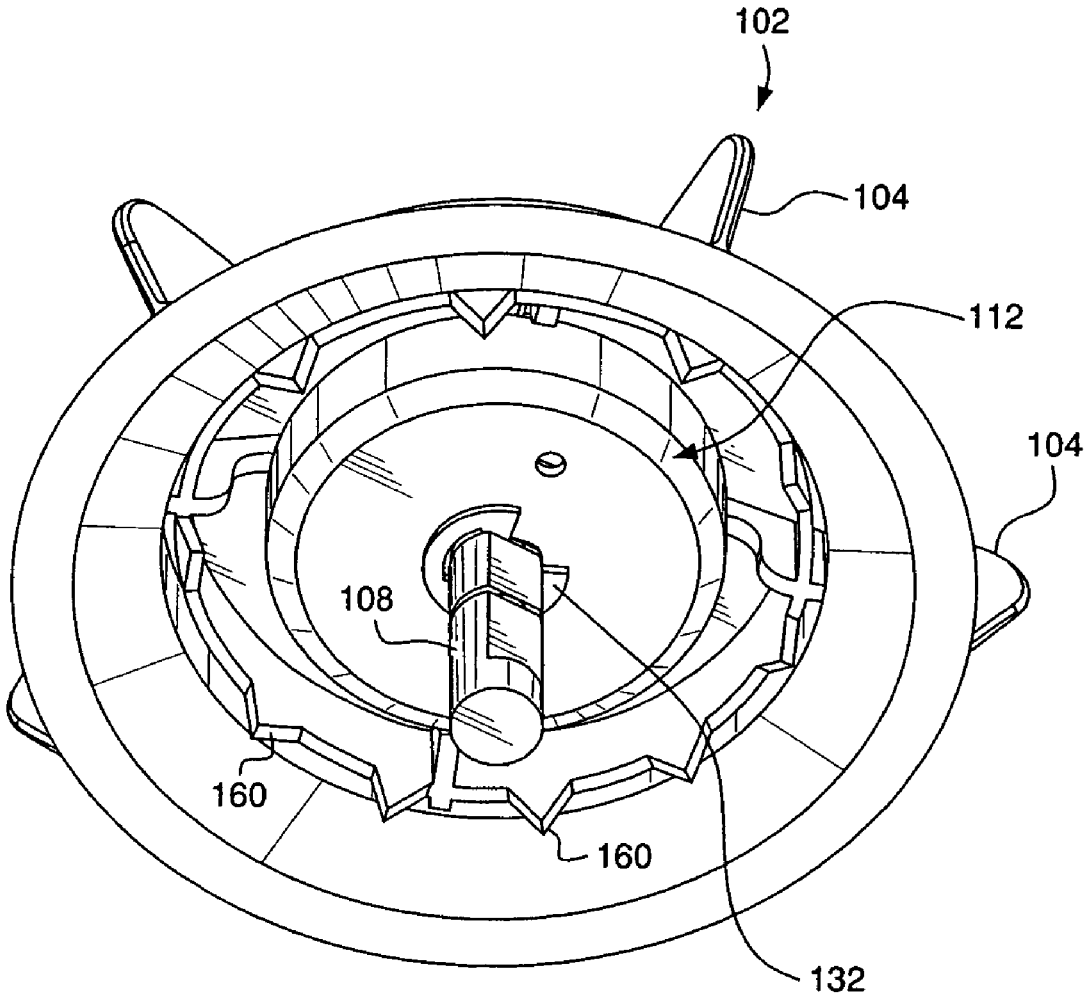
FIG. 4 is a lower isometric view of the embodiment of the loader shown in FIG. 3.

As shown in FIGS. 3 and 4, the drive mechanism 500 includes a spring housing 112 which is disposed about the drive shaft 108 and is positioned so as to be below the feeder 102. The spring housing 112 includes an outer wall 113 and a bottom wall 115. An inner wall 117 is formed about a central opening 119. The drive shaft 108 is designed to pass through the central opening 119 and engage with the spring housing 112 such that rotation of the drive shaft 108 produces concomitant rotation of the spring housing 112. In the illustrated embodiment, a portion of the drive shaft 108 is shown non-cylindrical in shape and the opening 119 is formed with a mating non-cylindrical shape. A spring clip 132 or similar fastener is preferably used to restrain vertical movement of the spring housing 112 on the drive shaft 108. This is more clearly illustrated in FIG. 4 which shows the spring housing 112 mounted to the drive shaft 108.

A second flange 120 is attached to or, more preferably, formed integral with the spring housing 112. The second flange 120 is configured to engage with a send end of the spring 116.

The inner wall 117 and outer wall 113 define a spring chamber 114 within the spring housing 112. A spring or other biasing member 116 is located within the spring chamber 114. Although a spring is shown in the figures, it should be readily apparent that other biasing members, such as elastomers, could instead be used. The spring 116 is preferably a torsion spring. A first leg 150 on the first end of the spring 116 is adapted to engage with the first flange 124 on the feeder 102. A second leg 152 on the second end of the spring is adapted to engage with the second flange 120 on the spring housing 112. As such, the spring 116 is mounted so as to bias the feeder 102 against rotation relative to the spring housing 112. In other words, rotation of the spring housing 112 relative to the feeder 102 produces deflection or winding of the spring 116. When the spring is rotated in the direction which produces winding of the spring, the rotation creates a restoring force (potential energy) in the spring which attempts to counter-rotate the spring housing 112 relative to the feeder 102. As should be readily apparent, if the feeder 102 is unrestrained, rotation of the spring housing will produce concomitant rotation of the feeder 102. It is only when there is something which inhibits rotation of the feeder 102 (such as paint balls already in the exit tube) that the spring housing 112 will wind the spring 116.

FIG. 4 illustrates the assembled feeder 102, spring housing 112, and the drive shaft 108. The drive shaft 108 projects downward from the spring housing 112 and is adapted to engage with a drive member or gear that is part of the drive mechanism 500.

Extending downward from the lower surface of the feeder 102 is at least one and, more preferably, a plurality of spaced apart upper indexing teeth 160. The upper indexing teeth 160 are preferably spaced in a circular pattern about the bottom of the feeder 102. As will be discussed below, the upper indexing teeth 160 are used in combination with a sensor to determine the rotational position of the feeder 102. The indexing teeth 160 are preferably formed integral with or attached to the feeder 102. While indexing teeth are shown in the illustrated embodiment, other indexing members, such as reflectors, markers, recesses, etc, may be used.

Figure 10:
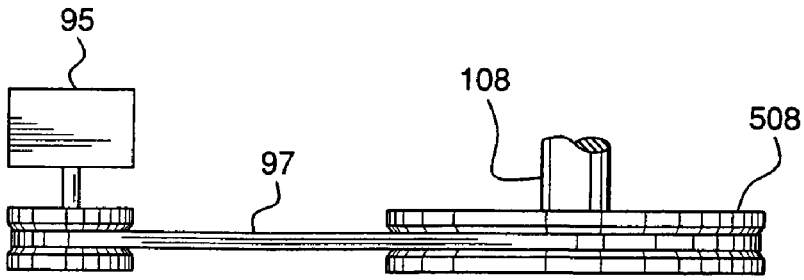
FIG. 10 illustrates a pulley mechanism for driving the drive shaft in accordance with an alternate embodiment of the invention.

Referring back to FIGS. 2 and 3, one embodiment of the drive member 508 is shown. In this embodiment, the drive member 508 is a drive gear includes a plurality of spaced apart gear teeth 503 formed about the periphery of the drive gear 508. The teeth 503 of the drive gear 508 are adapted to engage with mating teeth on a second gear connected to a motor 99. While the drive member 508 in the illustrated embodiment is a gear, other types of conventional drive members can be used to produce controlled rotation, such as a pulley mechanism or stepper motor. A pulley mechanism is shown in FIG. 10. The pulley 508 is engaged to the motor through a belt 99.

The drive member 508 also includes at least one and, more preferably, a plurality of lower indexing members 510 formed on the drive gear 508 and preferably on its lower surface. As with the upper indexing teeth 160, the lower indexing members 510 are used to determine the position of the drive gear 508 and, thus, the spring housing 112. While the indexing members are shown as protrusions in the illustrated embodiment, other indexing members, such as teeth, reflectors, markers, recesses, etc, may be used.

The feed mechanism 100 also includes a first indexing sensor positioned below and preferably adjacent to the lower surface of the feeder 102. The first indexing sensor 504 is located so as to be able to detect or otherwise sense the upper indexing teeth 160. More particularly, as the feeder 102 rotates around its central axis, the sensor 504 detects the upper indexing teeth 160 as they pass the sensor. The number of passing teeth 160 that is sensed (e.g., over a prescribed period) is used to determine the rotational motion of the feeder 102. As should be readily apparent, the more upper indexing teeth 160 that are formed on the feeder 102, the more accurate the position of the feeder 102 can be determined. A signal is sent from the sensor indicative of the sensed number of passing teeth. Alternatively, the sensor 504 may be a ratcheting mechanism that supplies the controller with a signal after the ratchet has rotated a predetermined number of times or amount.

A second indexing sensor 506 is mounted adjacent to the drive gear 508 so as to be able to detect the passing of the lower indexing members 510. The rotational motion of the drive gear 508 and, thus, the spring housing 112, is determined by counting the number of passing lower indexing members 510. A signal is sent from the sensor indicative of the sensed number of passing teeth. While the illustrated embodiment depicts the sensor and indexing members as being mounted to the drive gear, it should be readily understood that the sensor can be mounted so as to detect rotational motion of the drive shaft.

Figure 9:
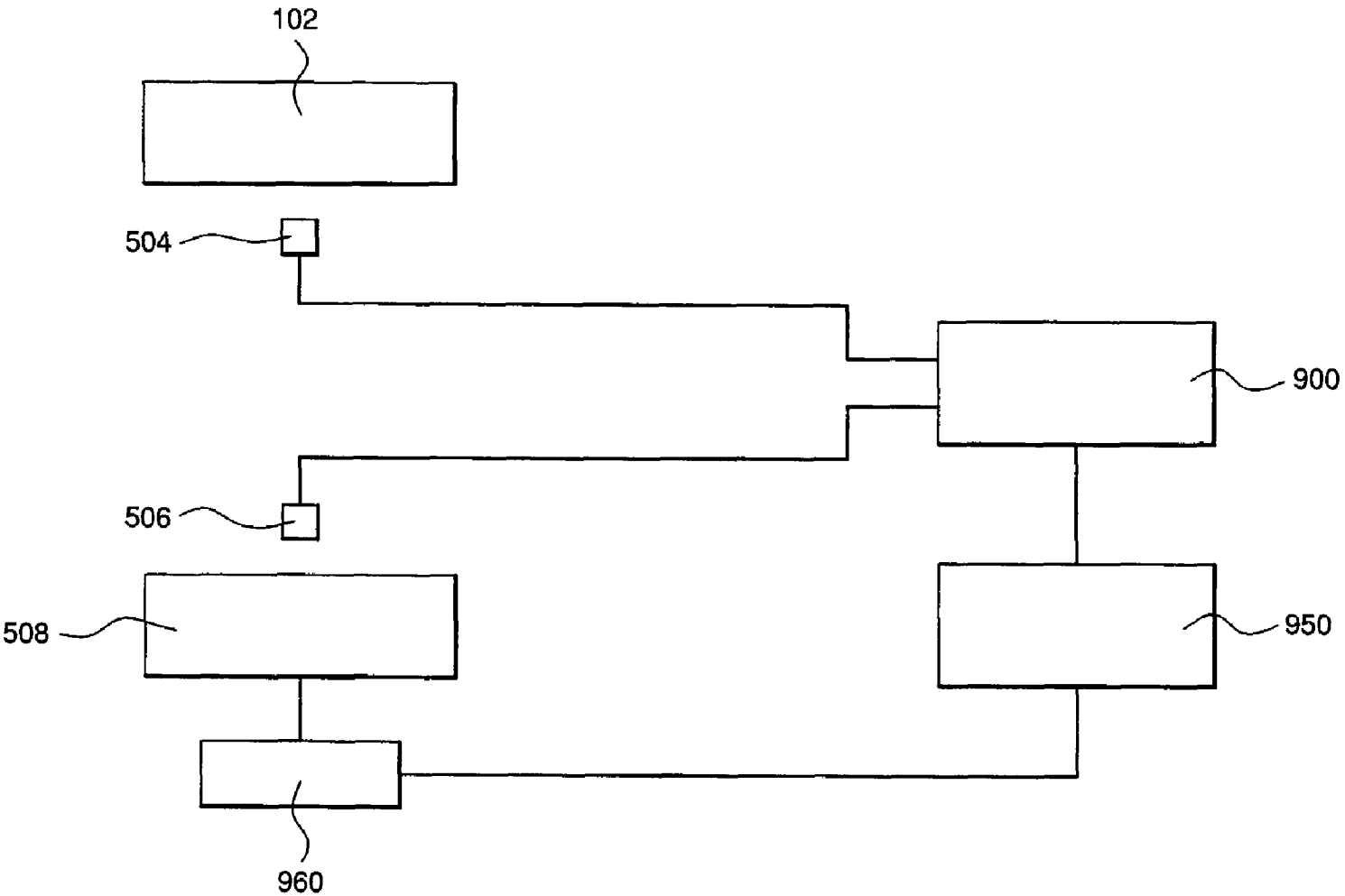
FIG. 9 is a schematic of a controller according to the present invention.

Referring to FIG. 9, the first indexing sensor 504 and second indexing sensor 506 are in communication with a controller 900, such as a computer or microprocessor (not shown). The controller 900 determines the position of the feeder 102 relative to the drive gear 508 and evaluates whether the spring 116 requires tensioning (winding) or deflection. If the controller 900 determines that the spring 116 requires tensioning, the controller will actuate a motor 950 which is engaged with the drive gear 508 to rotate the drive gear 508 a desired amount. The engagement is preferably through a drive system 960, such as a gear that meshes with the teeth 503 on the drive gear 508. Rotation of the drive gear 508, in turn, rotates the drive shaft 108 and, thus, the spring housing 112. The rotation of the spring housing 112 relative to the feeder 102 causes the spring 116 to wind, preferably until the second flange 120 meets the first flange 124.

During operation, as the feeder 102 advances the paint balls into the gun, the first sensor 504 counts the number of upper indexing teeth 160 that have passed and provides a signal to the controller. The second sensor 506, likewise, counts the number of lower indexing members 510 that have passed and provides a signal indicative thereof to the controller. It is envisioned that, during firing, the drive gear 508 may not necessarily be moving. Instead, only after the controller 900 detects that the positional location of the feeder 102 relative to the drive gear 508 correlates to a spring that needs "rewinding" would the controller 900 send a signal to the motor 950 to rotate the drive gear 508. For example, the system may be set such that only after half of the paintballs are dispensed that can be held by the feeder is the motor activated to rotate the drive gear 508.

Alternately, the controller 900 can continuously monitor the movement of the feeder 102 and the drive gear 508. Any movement of the feeder 102 relative to the drive gear 508 can result in the motor rotating the drive gear 508 to rewind the spring. Thus, the gun will always be set to feed the maximum number of balls possible using the feeder.

The controller 900 may also be programmed to rotate the drive gear 508 a prescribed distance to wind the spring, thus preventing overwinding. The lower indexing members 510 can be tracked through the second sensor 506 to stop the rotation of the drive gear 508 when desired. For example, the controller may be programmed to tension the spring a sufficient amount to feed 10 paintballs into the gun before needing to be rewound. Upon firing of the gun, tension of the spring will feed the 10 paintballs into the exit tube. The controller determines the number of balls to be fed from the data provided by the first indexing sensor 504.

Alternatively, the present invention may utilize only one sensor to detect the movement of the feeder. A motor, such as a stepper motor, can be used to incrementally wind the spring for every detected movement of the feeder. For example, if the spring has a tension sufficient to feed 10 paintballs, for every ball that the sensor detects as being fed by the feeder, the motor will wind the spring by 1/10th of the complete rotation.

The controller may be used to detect whether there are any paintballs in the exit tube. If the controller 900 determines that there are no paintballs in the tube, that would indicate that the spring is in an unwound condition. Thus, the controller 900 would activate the motor 950 and rewind the spring.

Figure 5:
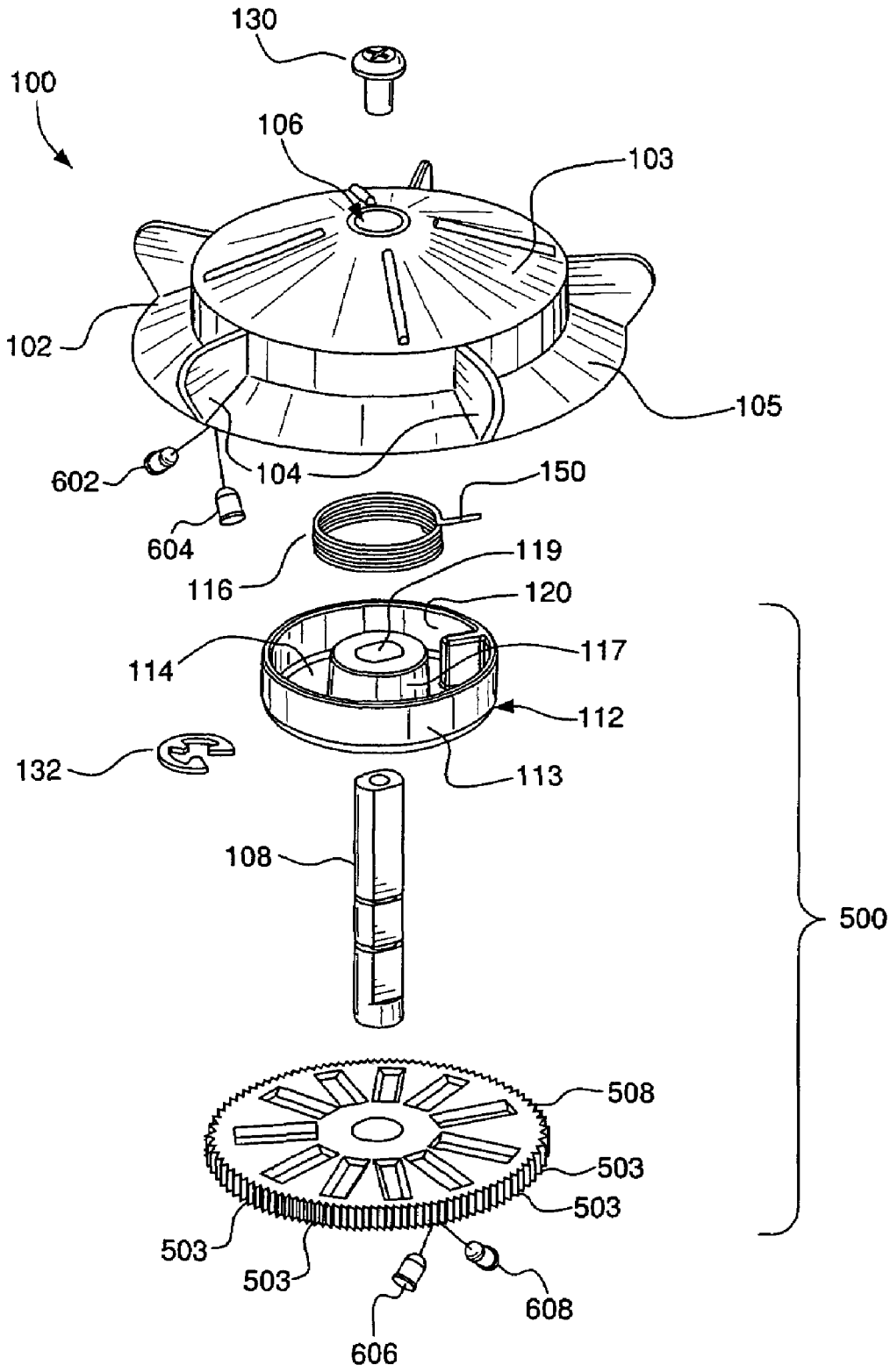
FIG. 5 is an exploded upper isometric view of a second embodiment of the loader according to the present invention.
Figure 6:
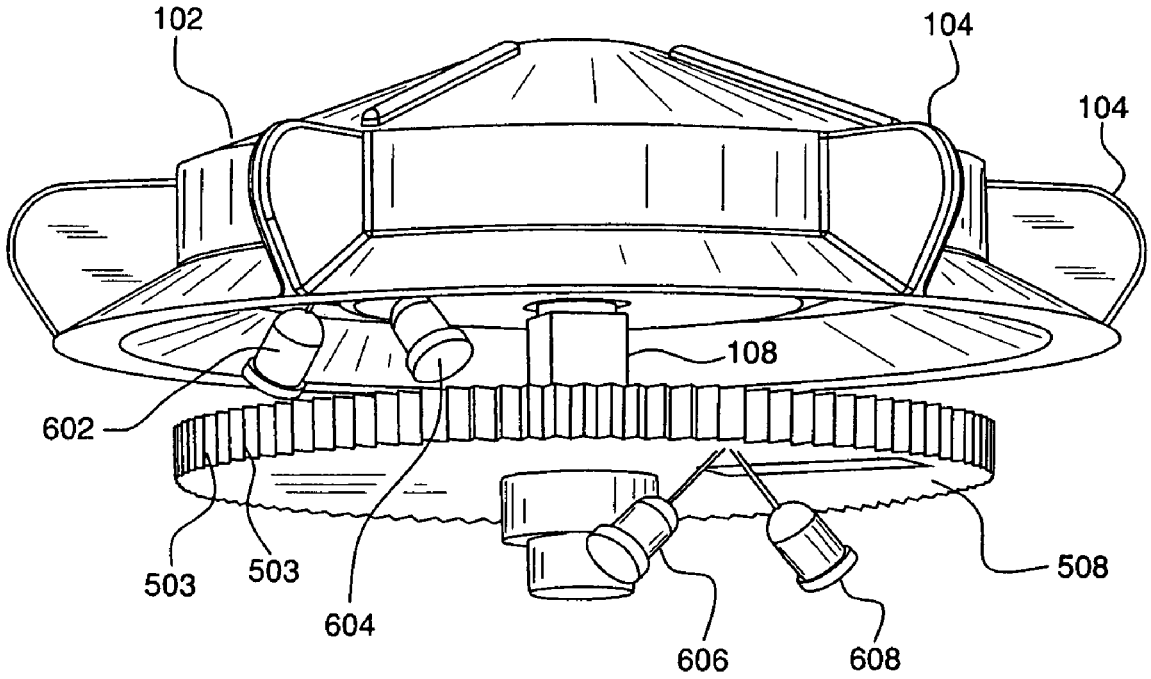
FIG. 6 is a side view of the loader of FIG. 5.

An alternate embodiment of the sensor mechanism is shown in FIG. 5. In this embodiment, the first sensor includes a first emitter 602 and a first receiver 604. The first emitter 602 provides a beam that is reflected by reflectors placed around the periphery of the underside of feed cone 102. The reflected signal is detected by receiver 604. Although depicted separately for clarity, the emitter 602 and receiver 604 may be housed in the same unit. The beam may be an infrared (IR) beam. Likewise a second emitter 606 and a second receiver 608 are provided in lieu of second indexing sensor 506. The second emitter 606 provides a beam that is reflected by reflectors placed around the periphery of the top or underside of drive gear 508. The reflected beam is detected by second receiver 608. The emitter 606 and receiver 608 may be housed in the same unit, or mounted separate as shown. The first and second emitters/receivers are in communication with the controller 900. FIG. 6 illustrates the assembled unit of FIG. 5.

The sensing mechanism may instead include a tensionometer or strain gauge 93 (shown in phantom in FIG. 2) to determine the tension of the spring. The strain gauge would be in communication with the controller. If the tension in the spring falls below a preselected limit, the controller will actuate the motor which rotates the drive mechanism that in turn rotates the spindle, thereby tensioning the spring.

Figure 7:
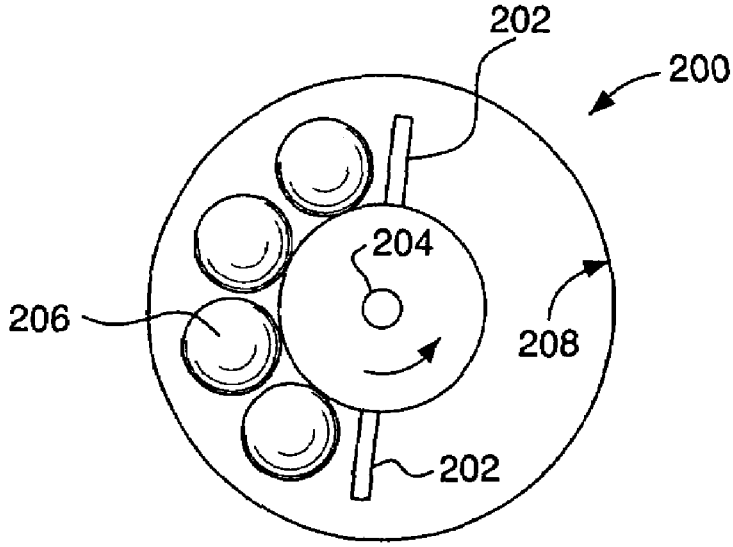
FIG. 7 is a top view of an alternate feeder according to the present invention.
Figure 8:
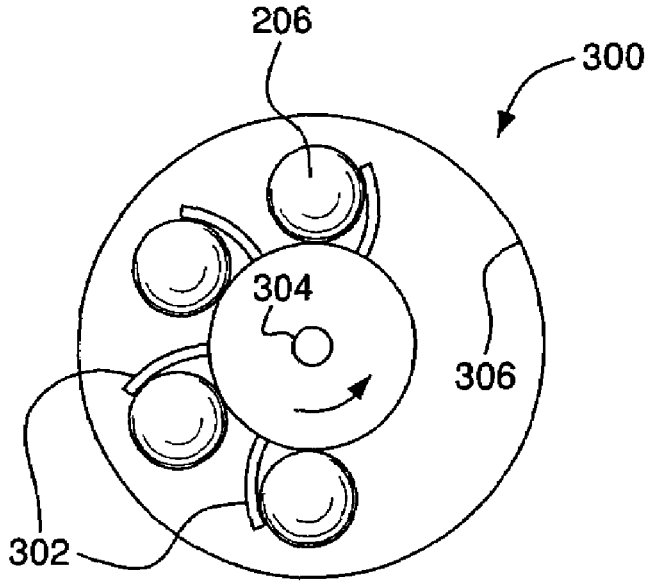
FIG. 8 is a top view of yet another feeder according to the present invention.

Referring to FIGS. 7 and 8, alternate feeder arrangements are shown. More particularly, FIG. 7 illustrates a feeder 200 which includes two fins 202. The fins are spaced 180 degrees apart, thus permitting a plurality of balls 206 to be located between adjacent fins 202. FIG. 8 illustrates a feeder with a plurality of curved fins 302, each one designed to cup an individual paintball 206. Those skilled in the art would be readily capable of substituting alternate design configurations for the feeder in order to effect sufficient feeding of the desired number of paint balls.

The present invention provides a novel system for feeding paintballs from a container. The use of a two sensors permits controlled feeding which is not possible with conventional feeders. The controller in the present invention can be adjusted to minimize use of the motor, thereby conserving battery power. The controller can also be used to accurately track the amount of balls dispensed.

Furthermore, the controller in the present invention can also be controlled so as to vary the tension and pressure applied to the ball supply. The feed mechanism can include a user input mechanism, such as a dial or pushbuttons, which permits the user to adjust when the drive mechanism re-winds the spring.

While the potential energy caused by the spring has been described as resulting from winding the spring, it should be readily apparent that a compression spring can be used, in which case the winding of the spring should be understood to refer to a compression of the spring to build up a restoring force or potential energy.

The present invention may be embodied in other specific forms without departing from the spirit thereof and, accordingly, reference should be made to the appended claims, rather than to the foregoing specification, as indicating the scope of the invention.

Although preferred embodiments of the sensors have been described and shown in the drawings, those skilled in the art will understand how features from the two embodiments may be combined and interchanged.

What is claimed is:

1. A paintball loader for use on a paintball gun, the paintball loader comprising:

a container for holding a plurality of paintballs;

a feed mechanism for feeding paintballs into a gun, the feed mechanism comprising:

a feeder mounted to the container that is rotatable about a central axis, the feeder including at least one indexing member that is a reflector and at least one fin for conveying a paintball toward an exit in the loader, a drive mechanism including a drive member adapted to rotate about the central axis relative to the feeder, and a spring having one end engaged with the feeder and the other end connected with the drive member, wherein rotation of the feeder with respect to the drive member causes winding and unwinding of the spring, the winding of the spring creating potential energy in the spring that is used to rotate the feeder and thus feed paintballs out of the loader;

a motor engaged with the drive member for rotating the drive member about the central axis;

a first sensor for sensing rotation of the feeder and providing a first signal indicative of the sensed rotation of the feeder, the first sensor detecting the at least one first indexing member by emitting a beam;

a second sensor for sensing rotation of the drive member and providing a second signal indicative of the sensed rotation of the drive member; and a controller in communication with the first and second sensors for receiving the first and second signals, the controller determining the position of the feeder relative to the drive member based on the first and second signal differential, the controller in communication with the motor for controlling activation of the motor.

2. The paintball loader of claim 1, wherein the drive member includes at least one second indexing member mounted so as to be detected by the second sensor.

3. The paintball loader of claim 2, wherein the at least one second indexing member is a reflector for reflecting a beam emitted by the second sensor.

4. The paintball loader of claim 1, wherein the first sensor is ratcheting mechanism which ratchets in response to rotation of the feeder.

5. The paintball loader of claim 1, wherein the first sensor is a tensionometer attached to the spring, and wherein the first signal is indicative of the degree of tension of the spring.

6. The paintball loader of claim 1, wherein the second sensor is a ratcheting mechanism which ratchets in response to rotation of the drive mechanism.

7. The paintball loader of claim 1, wherein the second sensor is an optical sensor.

8. The paintball loader of claim 1, wherein the drive member is a gear is a gear that meshes with a gear associated with the motor.

9. The paintball loader of claim 1, wherein the drive member is a pulley and wherein the motor is engaged with the pulley by a belt.

10. A paintball loader for use on a paintball gun, the paintball loader comprising:

a container for holding a plurality of paintballs;

a feed mechanism for feeding paintballs into a gun, the feed mechanism comprising:

a feeder mounted to the container and rotatable about an axis, the feeder including at least one paddle for conveying a paintball from the container toward an exit in the loader;

a drive member having a drive shaft, the drive member and shaft configured to rotate in combination about the axis;

a spring having one end engaged with the feeder and the other end connected with the drive shaft;

a motor engaged with the drive member for rotating the drive member about the axis;

a first sensor for sensing rotation of the feeder and providing a first signal indicative of the sensed rotation of the feeder;

a second sensor for sensing rotation of the drive member and providing a second signal indicative of the sensed rotation of the drive member; and a controller in communication with the first and second sensors for receiving the first and second signals, the controller determining the position of the feeder relative to the drive member based on the first and second signal differential, the controller in communication with the motor for controlling activation of the motor, the feeder including at least one first indexing member mounted so as to rotate in combination with the feeder and be detectable by the first sensor and the drive member including at least one second indexing member mounted so as to rotate in combination with the drive member and be detectable by the second sensor.

11. The paintball loader of claim 10, wherein the at least one of the first and second indexing members is a reflector and wherein the associated sensor senses light reflected off the reflector.

12. The paintball loader of claim 10, wherein the feed mechanism further comprising a spring housing attached to and adapted to rotate in combination with the drive shaft, wherein the spring is disposed within the housing, wherein the attachment of the spring to the drive member is provided by one end of the spring being engaged with the spring housing, and wherein the attachment of the spring to the feeder is provided by the other end of the spring being engaged with a flange formed on the feeder.

* * * * *